US005982079A

United States Patent [19]

Kibbey

[11] Patent Number: 5,982,079

[45] Date of Patent: Nov. 9, 1999

[54] SPARK PLUG WITH A LOOPED GROUND ELECTRODE CONCENTRICALLY DISPOSED TO A CENTER ELECTRODE

[76] Inventor: Wilbur R. Kibbey, 6717 Forrestvale La., Tampa, Fla. 33634

[21] Appl. No.: 08/774,233

[22] Filed: Dec. 27, 1996

Related U.S. Application Data

[60] Provisional application No. 60/009,407, Dec. 29, 1995.

[51] Int. Cl.[6] ..... H01T 1/22; H01T 13/20

[52] U.S. Cl. ..... 313/141; 313/139

[58] Field of Search ..... 313/139, 140, 313/141, 142, 143; 123/169 EL, 169 R, 169 MG, 169 EA

[56] References Cited

U.S. PATENT DOCUMENTS

| | | | |
|---|---|---|---|
| 1,163,281 | 12/1915 | Sullivan | 313/141 |
| 1,364,262 | 1/1921 | Faber | 313/141 |
| 1,495,499 | 5/1924 | Stanislawski | 313/140 |
| 2,048,481 | 7/1936 | Arnois | 123/169 PB |
| 2,299,924 | 10/1942 | Ost | 313/122 |
| 2,487,535 | 11/1949 | Fernandez | 313/139 |
| 2,894,162 | 7/1959 | Ignatjev | 313/141 |
| 3,468,004 | 9/1969 | Bretsch | 445/7 |
| 3,970,885 | 7/1976 | Kasima | 313/141 |
| 4,015,160 | 3/1977 | Lara et al. | 313/139 |
| 4,023,058 | 5/1977 | Lara et al. | 313/139 |
| 4,206,381 | 6/1980 | Wax | 313/139 |
| 4,267,481 | 5/1981 | Sauder | 313/139 |
| 4,268,774 | 5/1981 | Forkum, Jr. | 313/141 |
| 4,670,684 | 6/1987 | Kagawa et al. | 313/141 |
| 4,730,582 | 3/1988 | Lindsay | 313/143 |
| 4,914,343 | 4/1990 | Kagawa et al. | 313/139 |
| 4,916,354 | 4/1990 | Forkum, Jr. | 313/141 |
| 4,987,868 | 1/1991 | Richardson | 313/143 |
| 5,264,754 | 11/1993 | Hanitijo et al. | 313/139 |
| 5,280,214 | 1/1994 | Johnson | 313/139 |
| 5,430,346 | 7/1995 | Johnson | 313/141 |

FOREIGN PATENT DOCUMENTS

| | | | |
|---|---|---|---|
| 0167687 | 10/1986 | European Pat. Off. . | |
| 2612346 | 9/1988 | France | 313/141 |
| 187501 | 10/1922 | United Kingdom | 313/141 |

*Primary Examiner*—Jay M. Patidar
*Attorney, Agent, or Firm*—Gifford, Krass, Groh, Sprinkle, Patmore, Anderson & Citkowski, P.C.

[57] ABSTRACT

A high efficiency spark plug includes a ground electrode having formed of a wire having a circular cross section. The ground electrode has a pair of stanchions and a loop extending over the center electrode of the spark plug. The loop has a center circular portion and a pair of curved portions which form a gap between the two sides of the loop generally equal to the diameter of the wire.

6 Claims, 2 Drawing Sheets

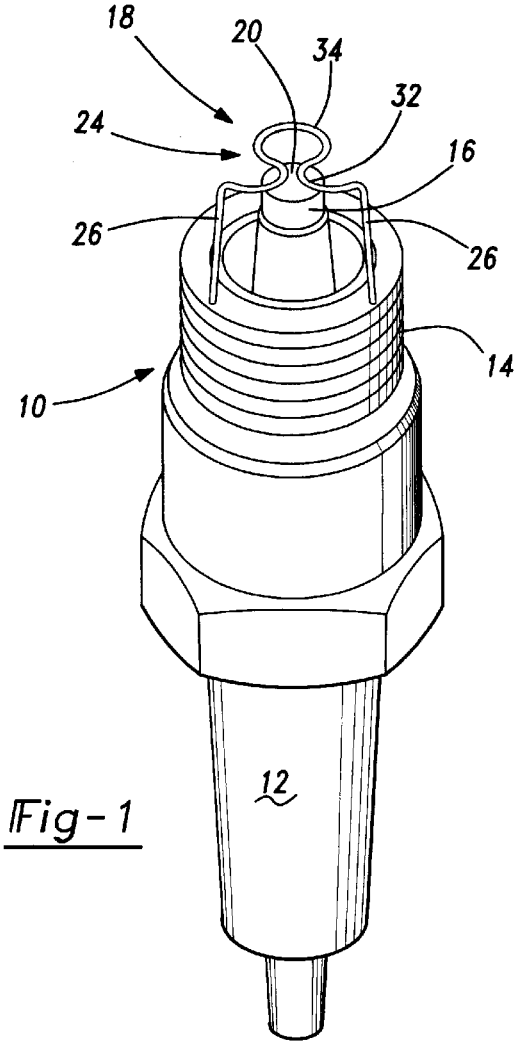
Fig-1
Fig-2
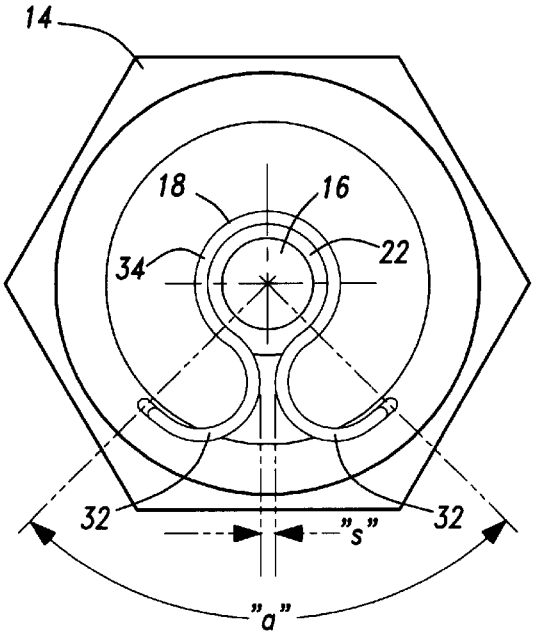
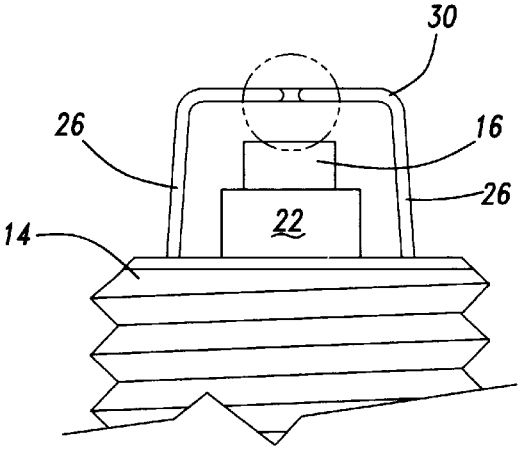
Fig-3
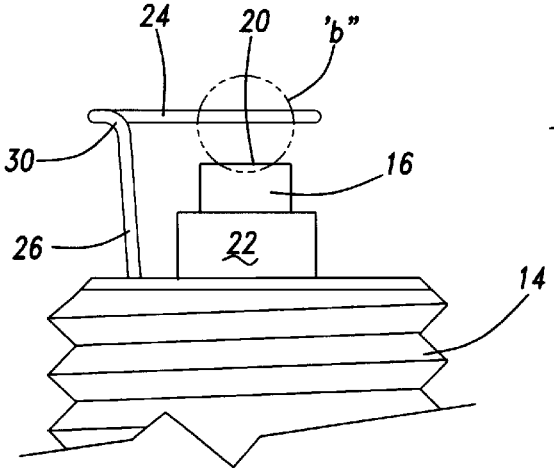
Fig-4

SPARK PLUG WITH A LOOPED GROUND ELECTRODE CONCENTRICALLY DISPOSED TO A CENTER ELECTRODE

BACKGROUND OF THE INVENTION

This application takes priority on U.S. provisional application Ser. No. 60/009,407 filed Dec. 29, 1995.

FIELD OF THE INVENTION

This invention relates to an improvement of a spark plug for an internal combustion engine.

PRIOR ART

Spark plugs have long been used in an internal combustion engine to ignite combustible gas within the cylinder. These spark plugs typically include a ground electrode having a flange which is supported in a spaced relationship by a rectangular support from a center electrode. During ignition electrons move between the electrodes to ignite the combustible gasses in the cylinder. A flame front is formed around the spark and moves outwardly from the spark towards the walls of the cylinder. In order to maximize the efficiency of the combustion to maximize the power from the ignition and to minimize emissions, it is desirable to provide the fastest possible speed in the movement of the flame front. It has also been found that efficiency of the burn can be reduced by a shadow in the flame front formed by the rectangular support of the ground electrode. The electrode blocks the flame front as it expands outwardly from the spark and causes a "shadow area" behind the support where the combustible gas is not efficiently or quickly burned. This slows the burning and resulting in a diminution of the power available from the combustion of the fuel. A high efficiency plug, known as the Splitfire plug, which is disclosed in U.S. Pat. No. 5,280,214, has a ground electrode with a "Y" shaped electrode. It has been found that carbon collects in the crotch thereby reducing the efficiency of the plug.

Because of the increased cost of fuel and necessity of minimizing the emissions from internal combustion engines, it is desirable to provide a spark plug which maximizes the efficiency of the burn of the combustible gasses.

Accordingly, it is an object of the present invention to provide a spark plug which produces a maximum flame front speed and expansion time.

It is a further object of the present invention to provide a spark plug which reduces or eliminates electrode shadow.

It is still another object of the present invention to provide a spark plug which produces an increase in engine power, fuel efficiency, and minimizes the emissions.

A further object of the invention is to provide a spark plug which is simple in structure and inexpensive to manufacture.

BRIEF SUMMARY OF THE INVENTION

Accordingly it has been found that flame propagation can be maximized by providing a spark plug which produces a spherical flame kernel which is unimpeded by electrode shadow or carbon collection. The spark plug includes a ground electrode which includes a loop supported by a pair of stanchions. The ground electrode has a circular cross section of minimum mass and is contoured to avoid any sharp points. The loop is spaced apart from a center electrode and has a center circular portion extending through an arc of approximately 270°. The loop is connected to the stanchions by support portions which curve together to a position radially outward with respect to the circular portion to define a narrow gap. The gap prevents formation of a carbon collection area. An arch portion curves outwardly and downwardly through an arc approximately 90° to extend between the support portions and the stanchions. The stanchions extend in a direction coaxial with the axis of the spark plug to a metal end of the plug. The stanchions are separated through an arc of approximately 90°. In the preferred embodiment the electrode is formed of a single wire having a minimum diameter as small as possible to maintain the shape. For most suitable metals such as alloys of nickel and cobalt the diameter of the wire is in the range of 0.030 inches plus or minus 0.015 inches.

The ground electrode promotes rapid propagation of the spark kernel and enhanced plasma expansion while presenting a minimum obstruction from the mass of the ground electrode. The circular cross section and contoured shape presents no sharp points and provides for fast heat sink properties. The thin wire stanchions minimize shadow to produce combustion of higher efficiency than other known spark plugs. The spark plug produces substantially increased torque, horse power and fuel economy while reducing carbon dioxide, carbon monoxide oxides of nitrogen and hydrocarbon emissions.

The aforementioned and other objects and features of the present invention shall be described hereinafter in detail with reference to the preferred embodiments thereof shown in the accompanying drawings in which:

BRIEF DESCRIPTION OF THE DRAWINGS

FIG. 1 is a perspective view of a spark plug according to the present invention;

FIG. 2 is an end view of the spark plug with ground electrode in accordance with the invention;

FIG. 3 is a partial front view of the ground electrode;

FIG. 4 is a partial side view of the ground electrode with the ground electrode rotated 90° from the view of FIG. 3.

DETAILED DESCRIPTION OF THE PREFERRED EMBODIMENT

Figure 5:
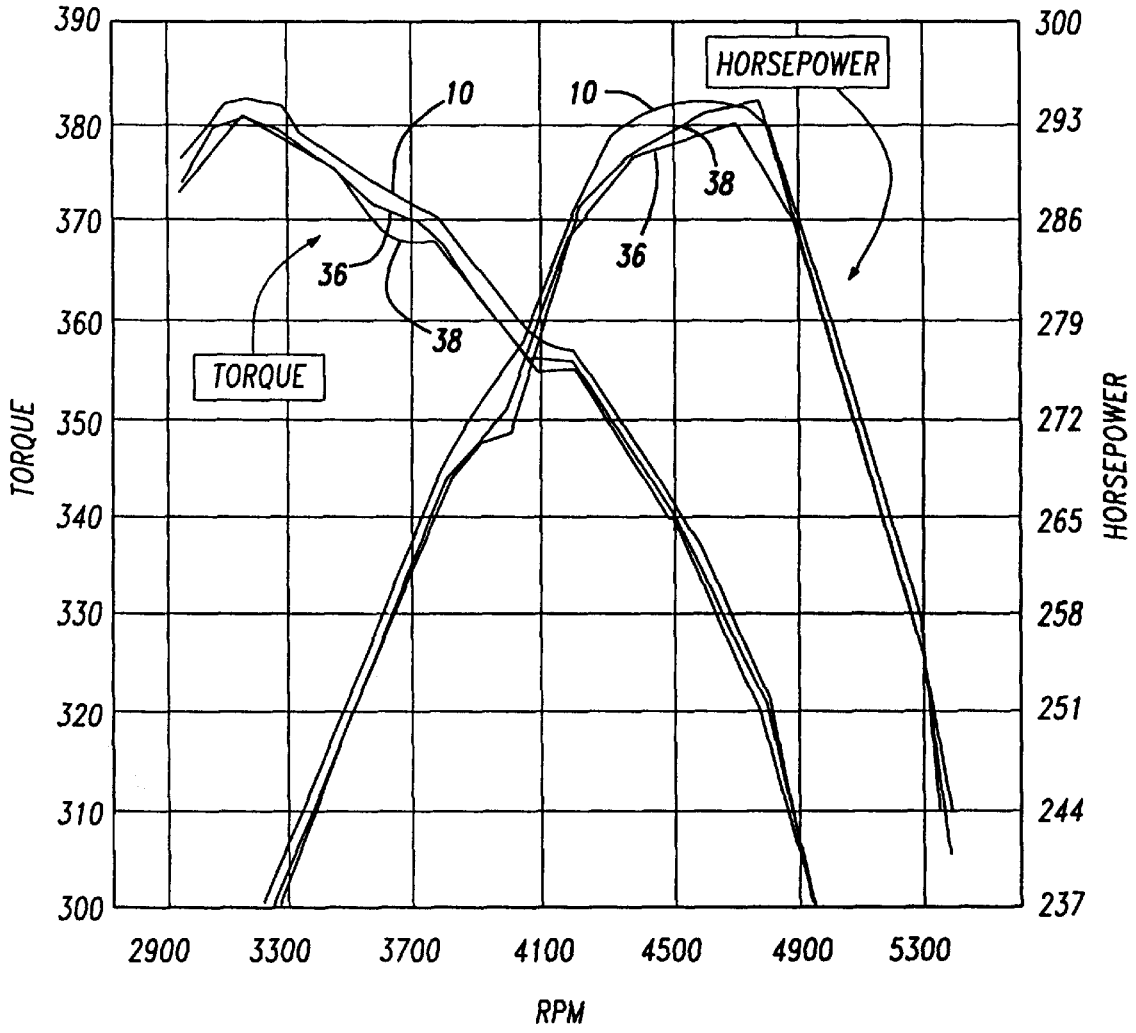
FIG. 5 is a chart comparison of torque and horsepower of the spark plug in accordance with the invention and prior art plugs.

A high efficiency spark plug 10 suitable for use in internal combustion engines is shown in FIG. 1. The spark plug 10 has a conventional threaded cylindrical body 12 and threaded metal end 14. The spark plug 10 further includes a center electrode 16 and a novel ground electrode 18. The center electrode 16 is a metal cylinder with a flat distal end 20. An inner portion is surrounded by a sleeve 22 of a dielectric material such as ceramic to isolate the center electrode 16 from the threaded metal mounting end 14. The center electrode, as shown in FIGS. 1 and 2, has a diameter in the range of between 0.025 and 0.125 inches, preferably 0.100 inch.

As best shown in FIG. 2, the ground electrode 18 includes a loop portion 24 supported in a spaced concentric relationship from the center electrode 16 by a pair of stanchions 26. The stanchions 26 extend from the threaded end 14 in a direction coaxial to the axis of the spark plug 10. The stanchions 26 are separated though an arc "a" in the range of 45° to 135° and preferably 90°. As shown in FIGS. 3 and 4, at the outer end of each stanchion 26 is an arc portion 30 which curves 90° towards the other stanchion, and has a radius ranging between 0.025 inches and 0.075 inches and in the preferred embodiment of 0.050 inches.

As best shown in FIG. 2, the loop portion 24 includes a pair of semicircular support portions 32 extending between a partial circular portion 34 and the stanchions 26. The support portions 32 curve radially outwardly from the partial circular portion 34 toward each other to form a space "5" and then continue to curve to the respective stanchions 26. The support portions 32 have a radius in the range from 0.025 to 0.075 inches and preferably 0.050 inches. The space "5" between the support portions 32 is approximately equal to the diameter of the ground electrode 18. The space prevents formation of a collection area for carbon. The partial circular portion 34 and the support portions 32 extend along a plane which extends in a radial direction with respect to an axis of the spark plug 10 and the circular portion 34 extends through an arc of between 225° and 315° and in the preferred embodiment is approximately 270° before curving outwardly to form the support portions 32. The diameter of the circular portion 34 is in the range from 0.7 to 1.3 times the diameter of the center electrode 16 and in the preferred embodiment equal to or slightly greater than the diameter of the center electrode or approximately 0.100 inches.

The ground electrode 18 is preferably formed of continuous wire having a diameter in the range from 0.015 inches to 0.45 inches and preferably 0.0325 inches. The diameter of the wire is dependent upon the metal which the wire is made from. The diameter is chosen to be the smallest possible permissible to permit to wire to hold the shape. It has been found that the smaller the diameter of the wire, the less hindrance of the propagation of the flame front during combustion. The ground electrode is formed of an alloy of nickel, cobalt. In the preferred embodiment Haynes Wire Heat No. 1880-3-1631 containing nickel and 30–40% cobalt and is used. The stanchions have a length to support the loop portion 24 a distance of typically approximately 0.010 to 0.125 from the end 20 of the center electrode 16. This distance is determined in the same manner as a conventional plug, but the distance between the loop and center electrode for the improved spark plug 10 is typically slightly less than in a conventional plug.

The spark plug in accordance with the invention produces a long duration, high intensity ignition with a spherical bubble "b" of hot ionized gas with a plasma layer on the outside encompassing the entire loop of the anode and electrode and the end of the electrode.

The spark plug according to the invention utilizing this alloy and having the preferred dimensions above is shown to provide greatly improved fuel usage and overall performance improvement, that is, horsepower, torque and combustion efficiency. As shown in Table 1 and FIG. 5, the torque and horsepower of the spark plug 10 according to the invention was compared with two high efficient prior art plugs, the AC RapidFire 36 and the SplitFire 38 spark plugs.

TABLE 1

| | IM | | SPLITFIRE | | RAPIDFIRE | |
|---|---|---|---|---|---|---|
| RPM | C TORQ | C PWR | C TORQ | C PWR | C TORQ | C PWR |
| 3000 | 375.9 | 214.7 | 373.1 | 213.3 | 373.6 | 213.8 |
| 3100 | 380.6 | 224.7 | 377.4 | 222.7 | 379.3 | 223.9 |
| 3200 | 382.3 | 232.9 | 380.7 | 232.0 | 380.5 | 231.9 |
| 3300 | 381.5 | 239.7 | 379.1 | 238.1 | 379.6 | 238.6 |
| 3400 | 378.6 | 245.2 | 377.7 | 244.5 | 376.9 | 244.0 |
| 3500 | 376.6 | 251.0 | 374.3 | 249.4 | 374.5 | 249.7 |

TABLE 1-continued

| | IM | | SPLITFIRE | | RAPIDFIRE | |
|---|---|---|---|---|---|---|
| RPM | C TORQ | C PWR | C TORQ | C PWR | C TORQ | C PWR |
| 3600 | 374.0 | 256.3 | 370.3 | 253.8 | 371.6 | 254.7 |
| 3700 | 372.7 | 262.6 | 368.3 | 259.5 | 370.4 | 260.9 |
| 3800 | 370.5 | 268.1 | 368.0 | 266.3 | 368.1 | 266.3 |
| 3900 | 366.4 | 272.0 | 362.9 | 269.5 | 363.9 | 270.2 |
| 4000 | 361.6 | 350.0 | 358.6 | 271.0 | 357.9 | 272.6 |
| 4100 | 358.1 | 279.5 | 355.3 | 277.4 | 356.1 | 278.0 |
| 4200 | 357.1 | 285.5 | 355.2 | 284.2 | 355.8 | 284.6 |
| 4300 | 353.8 | 289.7 | 350.7 | 287.2 | 352.5 | 288.6 |
| 4400 | 349.2 | 292.4 | 347.2 | 290.8 | 346.8 | 290.4 |
| 4500 | 343.4 | 294.1 | 340.9 | 292.2 | 340.0 | 291.3 |
| 4600 | 336.2 | 294.4 | 335.1 | 293.4 | 333.2 | 291.9 |
| 4700 | 328.6 | 294.0 | 328.3 | 293.8 | 327.1 | 292.7 |
| 4800 | 321.5 | 293.8 | 322.5 | 294.7 | 318.4 | 291.0 |
| 4900 | 309.6 | 288.8 | 309.3 | 288.5 | 309.0 | 288.2 |
| 5000 | 294.2 | 280.1 | 295.4 | 281.2 | 295.6 | 281.4 |
| 5100 | 281.1 | 272.9 | 280.8 | 272.7 | 280.7 | 272.6 |
| 5200 | 267.1 | 264.5 | 266.2 | 263.4 | 266.4 | 263.8 |

A modern computer control V-8 engine was utilized and the data was collected and stored in a computer incorporated as part of a dynamometer. The torque, power, oil temperature and other variables were collected for each spark plug at approximately 100 rpm intervals from 3,000 to 5,400 rpm. As shown in FIG. 5, it can be seen that the spark plug 10 of the invention produced greater torque and horsepower than the prior art plugs.

Although the present invention has been described with reference to preferred embodiments thereof, many modifications and alterations may be made within the spirit of the present invention.

I claim:

1. A spark plug for an internal combustion engine comprising:

an elongated body having a center electrode; and a ground electrode having a circular cross-section, said ground electrode having a pair of stanchions supporting a loop in a spaced apart relationship from said center electrode, said loop having a pair of connecting portions extending from each end of a partially circular center portion to one of said pair of stanchions, said center portion extending through an arc greater than 225°, each connecting portion curving inwardly towards each other to form a predetermined space between said connecting portions, said space positioned between said center portion and said pair of stanchions, said connecting portion curving outwardly from said space to a respective stanchion of said pair of stanchions, whereby said loop has a fully curved profile throughout.

2. The spark plug of claim 1, wherein said loop comprises a center circular portion coaxial with said center electrode.

3. The spark plug of claim 2, wherein said center circular portion extends through an arc of between 225° and 315°.

4. The spark plug of claim 1, wherein said space has a length of between 70% to 130% of the diameter of said center electrode.

5. The spark plug of claim 1, wherein said space is generally from 1 to 3 times the diameter of said center electrode.

6. A spark plug for an internal combustion engine comprising:

an elongated body having a center electrode; and a ground electrode having a circular cross-section, said ground electrode having a pair of stanchions and connecting portions supporting a loop in a spaced apart relationship from said center electrode, said loop having a predetermined diameter extending through an arc of 270°, said connecting portions extending between ends of said loop and said stanchions to form a predetermined space therebetween, said stanchions being spaced radially outwardly from said space and separated by an arc of 45° to 90°.

* * * * *

UNITED STATES PATENT AND TRADEMARK OFFICE

CERTIFICATE OF CORRECTION

PATENT NO. : 5,982,079

DATED : November 9, 1999

INVENTOR(S) : Wilbur R. Kibbey

It is certified that error appears in the above-identified patent and that said Letters Patent are hereby corrected as shown below:

Column 1, line 42 - Replace "gasses" with --gases--.
Column 2, line 23 - Insert --,-- after "monoxide".
Column 3, line 7 - Replace "5" with --S--.
Column 3, line 11 - Replace "5" with --S--.
Column 3, line 53 - Insert --(identified as "IM" in Table 1)-- after "10".

Signed and Sealed this

Tenth Day of April, 2001

*Attest:*

Nicholas P. Godici

NICHOLAS P. GODICI

*Attesting Officer*

*Acting Director of the United States Patent and Trademark Office*